US008905219B2

(12) United States Patent
Iwasaki et al.

(10) Patent No.: US 8,905,219 B2
(45) Date of Patent: Dec. 9, 2014

(54) BANKNOTE PROCESSING DEVICE

(71) Applicant: Oki Electric Industry Co., Ltd., Tokyo (JP)

(72) Inventors: Satoru Iwasaki, Gunma (JP); Shuuichi Hiratsuka, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/002,693

(22) PCT Filed: Mar. 4, 2013

(86) PCT No.: PCT/JP2013/055879

§ 371 (c)(1), (2), (4) Date: Aug. 30, 2013

(87) PCT Pub. No.: WO2013/146114

PCT Pub. Date: Oct. 3, 2013

(65) Prior Publication Data

US 2014/0144749 A1 May 29, 2014

(30) Foreign Application Priority Data

Mar. 27, 2012 (JP) ..... 2012-071813

(51) Int. Cl.
*G07F 7/04* (2006.01)
*G07D 11/00* (2006.01)

(52) U.S. Cl.
CPC ..... *G07D 11/0084* (2013.01); *G07D 11/0006* (2013.01); *G07D 11/0081* (2013.01)
USPC ..... 194/206

(58) Field of Classification Search
CPC ..... G07F 7/04; G07F 19/00; G07F 19/202; G07F 19/203; G07D 11/00; G07D 11/0006; G07D 11/0021
USPC ..... 194/206, 207, 350; 209/534
See application file for complete search history.

(56) References Cited

U.S. PATENT DOCUMENTS

| | | | | |
|---|---|---|---|---|
| 6,796,434 | B2 * | 9/2004 | Kako et al. | 209/603 |
| 2005/0056519 | A1 | 3/2005 | Yokoi et al. | |
| 2005/0189266 | A1 | 9/2005 | Fujita et al. | |
| 2007/0017775 | A1 * | 1/2007 | Voser | 194/207 |
| 2007/0221469 | A1 * | 9/2007 | Katou et al. | 194/206 |
| 2010/0163366 | A1 * | 7/2010 | Jenrick et al. | 194/206 |

FOREIGN PATENT DOCUMENTS

| | | | |
|---|---|---|---|
| JP | H11-224362 | A | 8/1999 |
| JP | 2005-092421 | A | 4/2005 |
| JP | 2005-208954 | A | 8/2005 |
| JP | 2011-002921 | A | 1/2011 |

* cited by examiner

*Primary Examiner* — Mark Beauchaine
(74) *Attorney, Agent, or Firm* — Rabin & Berdo, P.C.

(57) ABSTRACT

A banknote processing device includes a differentiating section that differentiates banknotes, a temporary holding section that temporarily stores the differentiated banknotes, banknote storage containers that store the banknotes, and a conveyance route that connects the differentiating section, the temporary holding section, and the banknote storage containers. The processing device is constructed so that when the banknotes stored in the temporary holding section are sent out and stored in the banknote storage containers based on differentiation results of the banknotes by the differentiating section, the banknotes are conveyed from the temporary holding section via the differentiating section, and are stored in any one of the banknote storage containers, or the banknotes are conveyed from the temporary holding section, via a route that does not go through the differentiating section, and are stored in a specific one of the banknote storage containers.

11 Claims, 13 Drawing Sheets

BANKNOTE PROCESSING DEVICE

TECHNICAL FIELD

The present invention relates to a banknote processing device that may be suitably applied to, for example, an automated teller machine installed in financial institutions or the like.

BACKGROUND ART

Conventionally, for example, as illustrated in FIG. 13, a banknote deposit and withdrawal device 100, installed in an automated teller machine, includes a deposit and withdrawal port section 101 serving as an inserting port and a receiving port of banknotes, an differentiating section 102 that differentiates denominations, authenticity, or the like of the banknotes, an temporary holding section 103 that temporarily holds the banknotes, plural banknote storage containers 104 that keep the banknotes for each denomination thereof, a reject container 105 that keeps the rejected banknotes, a conveyance route 106 that connects the above components and the like.

In the banknote deposit and withdrawal device 100, when a user inserts banknotes into the deposit and withdrawal port section 101 at the time of deposit transaction, the banknotes are conveyed to the differentiating section 102, the banknotes differentiated as normal banknotes by the differentiating section 102 are conveyed to the temporary holding section 103 and stored therein, and on the other hand, the banknotes differentiated as deposit rejected banknotes that are not suitable for the deposit are sent back to the deposit and withdrawal port section 101 and are returned to the user.

Thereafter, when the amount of the deposit is confirmed by the user, the banknotes stored in the temporary holding section 103 are conveyed to the differentiating section 102 and the denominations thereof are differentiated, and the banknotes are conveyed to the respective banknote storage containers 104 depending on the denominations thereof and are kept therein.

Meanwhile, at the time of withdrawal transaction, when the amount of the withdrawal is specified by the user, the banknote deposit and withdrawal device 100 sends out the banknotes corresponding to the specified amount of the withdrawal from the respective banknote storage containers 104 and conveys the banknotes to the differentiating section 102. Furthermore, the banknote deposit and withdrawal device 100 conveys the banknotes, which are differentiated as the normal banknotes by the differentiating section 102, to the deposit and withdrawal port section 101, and on the other hand, the banknote deposit and withdrawal device 100 conveys the banknotes, which are differentiated as the withdrawal rejected banknotes that are not suitable for the withdrawal, to the temporary holding section 103 to be stored therein.

Thereafter, the banknote deposit and withdrawal device 100 conveys the withdrawal rejected banknotes stored in the temporary holding section 103 to the reject container 105, and stores the banknotes therein (for example, see Japanese Patent Application Laid-Open (JP-A) No. 2011-2921).

SUMMARY OF INVENTION

Technical Problem

In the conventional banknote deposit and withdrawal device, such as the above-mentioned banknote deposit and withdrawal device 100, since the differentiating section is provided on the conveyance route between the temporary holding section, and the banknote storage containers and the reject container, when the banknotes are conveyed from the temporary holding section to the banknote storage containers and the reject container, there is a need to go through the differentiating section.

In this case, for example, the banknotes to be directly conveyed from the temporary holding section to the reject container also needs to go through the differentiating section, with the result that a conveying distance increases.

When the conveying distance increases, the rate of occurrence of a failure, such as a jam, increases accordingly. Especially, when the banknotes such as the rejected banknotes to be stored separately from the normal banknotes are jammed during conveying, it is difficult to distinguish the rejected banknotes from the normal banknotes, which may disturb the maintenance.

Thus, for such banknotes, namely, for the banknotes or the like to be stored separately from the normal banknotes, if the conveying distance from the temporary holding section to the storing place thereof (for example, the reject container) are shortened as much as possible to reduce the rate of occurrence of a failure such as a jam, as a result, it is considered that the whole rate of occurrence of a failure may also be reduced.

The present invention has been made in view of the above circumstances, and an object thereof is to suggest a banknote processing device capable of further reducing the rate of occurrence of a failure compared to the conventional art.

Solution to Problem

In order to solve the problems, a banknote processing device of the present invention includes an differentiating section that differentiates banknotes; an temporary holding section that temporarily stores the banknotes differentiated by the differentiating section; plural banknote storage containers that store the banknotes; and a conveyance route that connects the differentiating section, the temporary holding section, and the plural banknote storage containers, wherein when the banknotes stored in the temporary holding section are stored at the plural banknote storage containers, based on differentiation results of the banknotes by the differentiation section, the banknotes are conveyed from the temporary holding section, via the differentiating section, to any one of the plural banknote storage containers and are stored therein, or the banknotes are conveyed from the temporary holding section, via a route that does not go through the differentiating section, to a specific banknote storage container among the plural banknote storage containers and are stored therein.

By the above configuration, for example, since the banknotes to be stored separately from the normal banknotes are conveyed to the specific banknote storage container among the plural banknote storage containers in the route that does not go through the differentiating section from the temporary holding section and are stored therein, compared to a case of conveying the banknotes in the route that necessarily goes through the differentiating section as in the conventional art, as the banknotes are directly conveyed to the storing place from the temporary holding section, the conveying distance from the temporary holding section to the storing place may be shortened, and may reduce the rate of occurrence of a failure due to the banknotes to be stored separately from the normal banknotes.

Advantageous Effects of Invention

According to the present invention, the rate of occurrence of a failure due to the banknotes to be stored separately from the normal banknotes may be reduced. Accordingly, the banknote processing device capable of further reducing the rate of occurrence of a failure compared to the conventional art may be achieved.

DESCRIPTION OF EMBODIMENTS

Hereinbelow, embodiments of the present invention will be described in detail using the drawings.

[1. Configuration of Automated Teller Machine]

Figure 1:
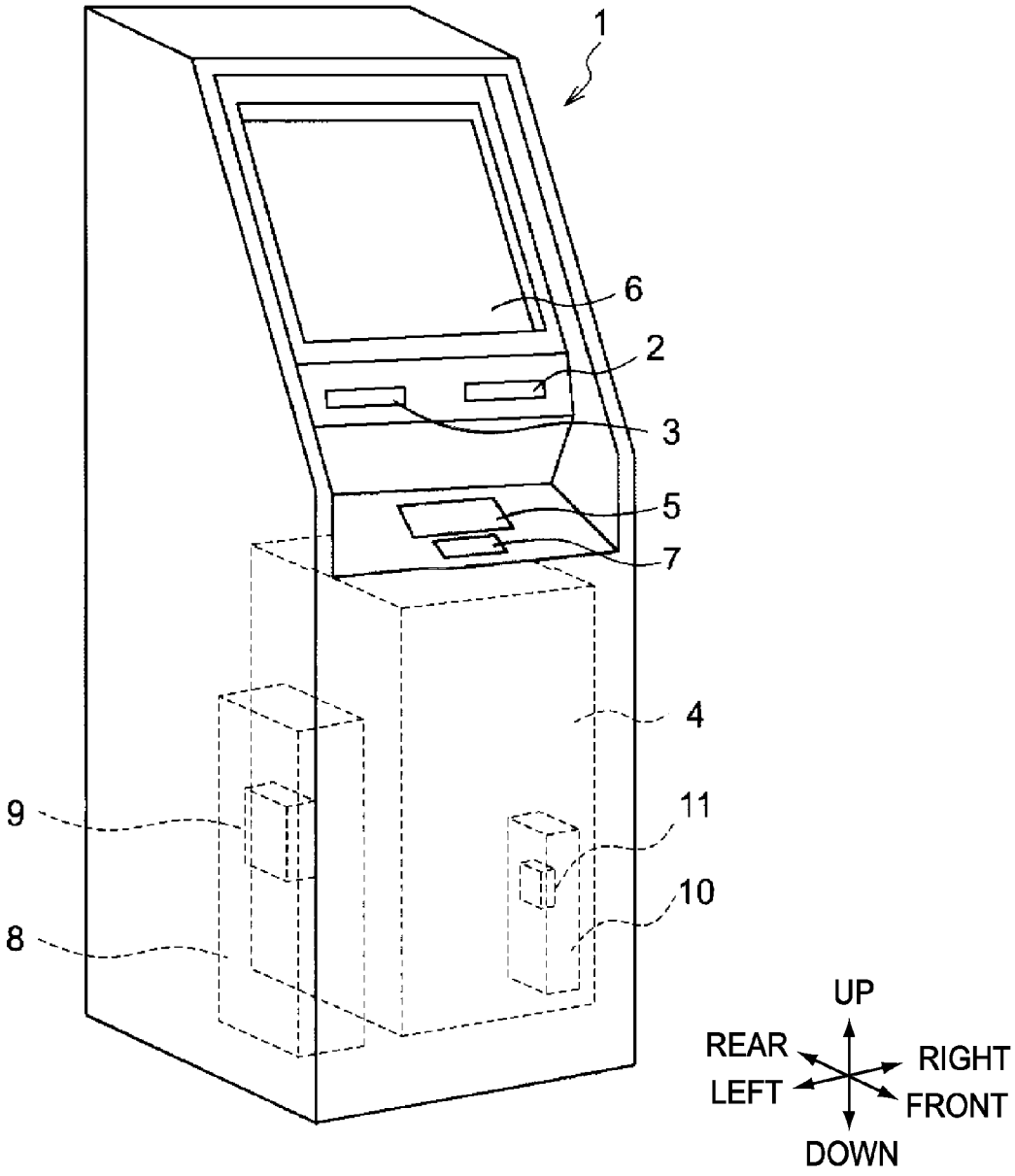
FIG. 1 is a schematic diagram that illustrates a configuration of an ATM.

FIG. 1 illustrates an outline of a whole configuration of an automatic teller machine (hereinbelow, also referred to as an ATM) 1.

The ATM 1 is configured to perform the processing, such as a deposit, a payment, and a transfer of a cash, by operation of a user using a cash card, a banknote, an account statement on transaction or the like, as a transaction medium.

In the upper inner portion of the ATM 1, a card processing machine (not illustrated) configured to process the cash card or the like of the user, and a receipt printer (not illustrated) configured to print the account statement on transaction (hereinafter, also referred to as a receipt) and issue a receipt to the user, are provided.

The card processing machine processes a cash card of the user that is inserted from a card insertion and return port 2 provided on a front face (a face facing the user) of the ATM 1. The receipt printer discharges the account statement on transaction from a receipt issuing port 3 provided on the front face of the ATM 1 to the user.

Furthermore, a banknote deposit and withdrawal device 4 for processing banknotes is provided in the lower inner portion of the ATM 1. A deposit and withdrawal port shutter 5, exposed on the front face of the ATM 1, is provided above the front face of the banknote deposit and withdrawal device 4, and the deposit and the withdrawal of the banknotes are performed depending on opening and closing of the deposit and withdrawal port shutter 5.

Furthermore, on the front face of the ATM 1, an operation display section 6 which displays the transaction contents of the user and to which various information and items for transaction are input, and a numerical keyboard 7, to which a password or the like is input, are provided.

Furthermore, a main control section 8 configured to generally control the whole ATM 1 to control each section mentioned above, and a memory section 9 configured to store operational information or the like of the ATM 1 are provided inside the ATM 1.

Furthermore, separately from the main control section 8 and the memory section 9, a control section 10 configured to control the banknote deposit and withdrawal device 4, and a memory section 11 serving as a memory area of the control section 10, are provided inside the banknote deposit and withdrawal device 4.

[2. Configuration of Banknote Deposit and Withdrawal Device]

Figure 2:
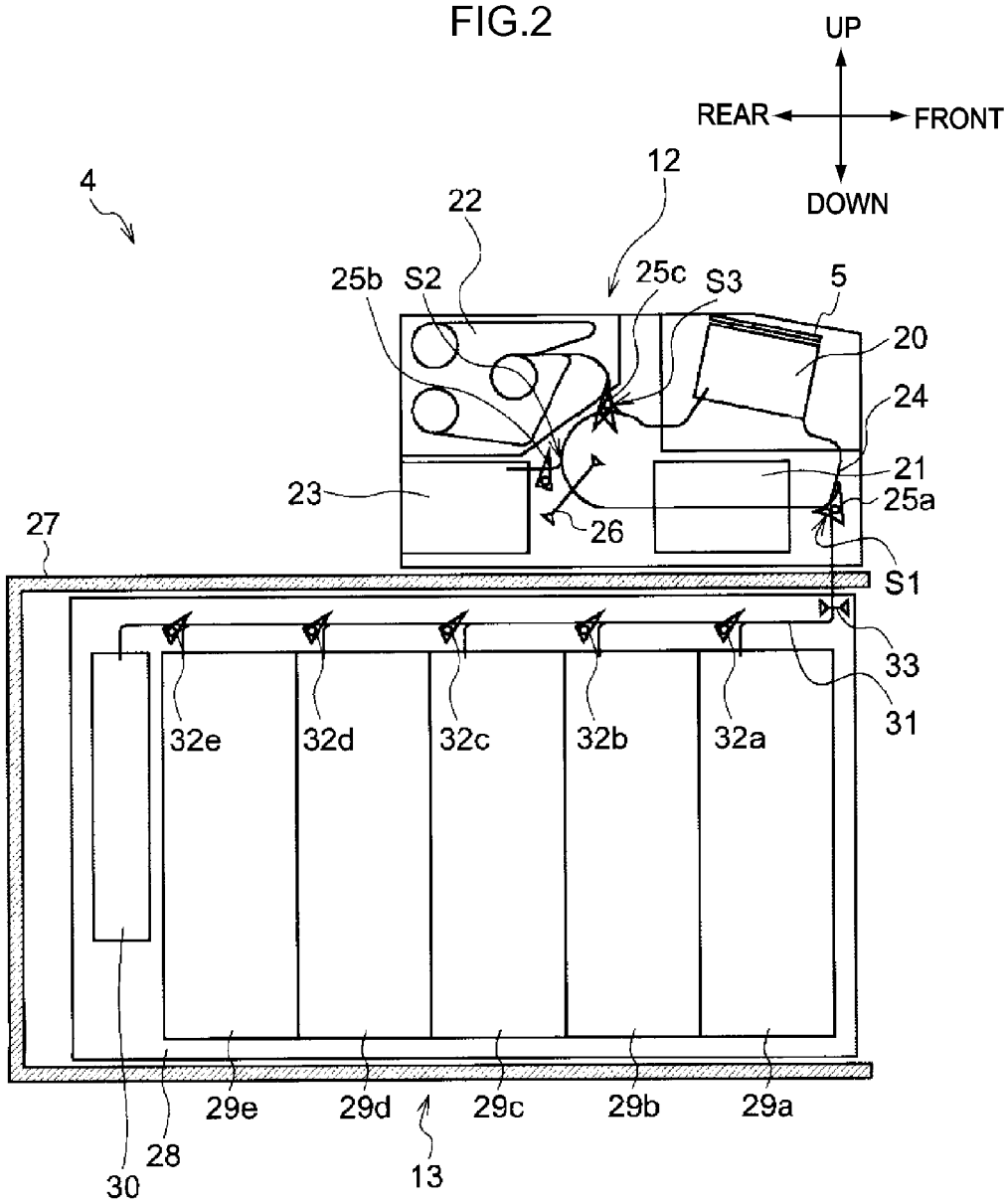
FIG. 2 is a schematic diagram that illustrates an internal configuration of a banknote deposit and withdrawal device.

Next, an internal configuration of the banknote deposit and withdrawal device 4 will be described using FIG. 2.

This banknote deposit and withdrawal device 4 is a so-called recycle type banknote deposit and withdrawal device that uses the deposited banknotes for the withdrawal. The banknote deposit and withdrawal device 4 includes an upper housing 12 on the upper side, a lower housing 13 on the lower side, and the control section 10 (not illustrated in FIG. 2).

In the upper housing 12, a deposit and withdrawal port section 20 serving as a deposit port and a withdrawal port of the banknotes is provided above the front face of the upper housing 12. The above-mentioned deposit and withdrawal port shutter 5 is provided in this deposit and withdrawal port section 20.

Furthermore, in the upper housing 12, a differentiating section 21, configured to differentiate authenticity, deformation, denomination, conveying status or the like of the banknotes, is disposed below the deposit and withdrawal port section 20, and an temporary holding section 22 configured to temporarily keep the banknotes is disposed behind the deposit and withdrawal port section 20.

This temporary holding section 22 is an temporary holding section of a drum winding type that stores the banknotes by winding the banknotes on a drum in a state of pinching the banknotes between upper and lower tapes. The drum winding type is advantageous in that the order of the banknotes is secured, and the banknotes can be sent out exactly one by one in the reverse order of the time of storing.

Furthermore, in the upper housing 12, a banknote storage container 23 is disposed adjacent to the lower side of the temporary holding section 22. Note that the banknote deposit and withdrawal device 4 is set such that the banknote storage container 23 is used as a reject container. Accordingly, the banknote storage container 23 may also be referred to as a reject container 23 herein.

Furthermore, in the upper housing 12, a conveyance route (this conveyance route is referred to as an upper conveyance route herein) 24 that connects the deposit and withdrawal port section 20, the differentiating section 21, the temporary holding section 22, and the reject container 23 is provided.

Namely, the upper conveyance route 24 is connected to the front bottom face of the deposit and withdrawal port section 20, extends downward therefrom, and branches to downward and to rearward on its way. A portion branching downward from a branching portion S1 is connected to the lower housing 13 on the lower side as it is, and a portion branching rearward is connected to the differentiating section 21.

Furthermore, at this branching portion S1, a switcher 25*a* is provided which is capable of switching the conveying direction of the banknotes to two directions, that is, rearward (the differentiating section 21 side) and downward (the lower housing 13 side).

Additionally, the upper conveyance route 24 passes through the differentiating section 21, is folded back so as to draw an arc upward from there, and is connected to the backside of the bottom face of the deposit and withdrawal port section 20.

Furthermore, the upper conveyance route 24 branches rearward at the center of the portion folded back so as to draw an arc upward, and is connected to the reject container 23.

At a branching portion S2, a switcher 25*b* is provided which is capable of switching the conveying direction of the banknotes to three directions, that is, upward (the temporary holding section 22 side and the deposit and withdrawal port section 20 side), rearward (the reject container 23 side), and downward (the differentiating section 21 side).

Furthermore, the upper conveyance route 24 branches upward at the upper end of the portion folded back so as to draw an arc upward, and is connected to the temporary holding section 22.

At a branching portion S3, a switcher 25*c* is provided which is capable of switching the conveying direction of the banknotes upward (the temporary holding section 22 side), forward (the deposit and withdrawal port section 20 side), and rearward (the reject container 23 side and the differentiating section 21 side).

Furthermore, at a predetermined location (for example, a lower end portion of the portion folded back so as to draw an arc upward) of this upper conveyance route 24, a sensor 26 is disposed for detecting the passage or the like of the banknotes.

The lower housing 13 is configured such that a banknote storing section 28 is provided inside a safe housing 27 surrounded by a thick steel plate.

This banknote storing section 28 is able to slide in a front-back direction so that the banknote storing section 28 can be drawn out of the front face of the ATM 1, for example, at the time of maintenance or the like.

Plural (for example, five) vertical banknote storage containers 29*a* to 29*e* are disposed side by side in the banknote storing section 28 in the front-back direction. Furthermore, a banknote storage container 30 smaller than the banknote storage containers 29*a* to 29*e* is disposed behind the rearmost banknote storage container 29*e*.

Note that the banknote deposit and withdrawal device 4 is set so that the banknote storage container 30 is used as a reject container. For this reason, the banknote storage container 30 is also referred to as a reject container 30 herein.

Additionally, in the banknote storing section 28, a conveyance route (the conveyance route is referred to as a lower conveyance route herein) 31 extending in the front-back direction is provided above the five banknote storage containers 29 (29*a* to 29*e*) and the reject container 30.

This lower conveyance route 31 is connected to each of the five banknote storage containers 29 (29*a* to 29*e*) and the reject container 30, and a leading end portion of the lower conveyance route 31 extends upward and is connected to the upper conveyance route 24.

Furthermore, in the lower conveyance route 31, switchers 32*a* to 32*e* capable of switching the conveying direction forward (the upper conveyance route 24 side), rearward (the next banknote storage container 29 or the reject container 30 side), and downward (the banknote storage container 29 side) are provided at each of connection locations with the five banknote storage containers 29 (29*a* to 29*e*).

Additionally, a sensor 33 for detecting the passage of the banknotes or the like is provided at a predetermined location (for example, a portion extending above the leading end) of the lower conveyance route 31.

The control section 10 (not illustrated in FIG. 2) performs the deposit processing and the withdrawal processing of the banknotes by controlling each section of the upper housing 12 and the lower housing 13 based on the differentiation results of the banknotes by the differentiating section 21, and the detection result by the sensors 26 and 33 or the like.

[3. Operation of Banknote Deposit and Withdrawal Device at the Time of Deposit Transaction and at the Time of Withdrawal Transaction]

[3-1. Counting of Banknote at the Time of Deposit Transaction]

Next, the operation of the banknote deposit and withdrawal device 4 at the time of deposit transaction and at the time of withdrawal transaction will be described. Note that the operation is performed mainly based on the control of the control section 10. Hereinafter, firstly, the counting of the banknotes at the time of deposit transaction will be described using FIG. 3.

In the banknote deposit and withdrawal device 4, a cash card or the like is inserted into the ATM 1 by the user, and when the transaction items (in this case, the deposit) or the like is input via the operation display section 6, the deposit and withdrawal port shutter 5 is opened. Accordingly, the banknote deposit and withdrawal device 4 enters to a state in which the banknotes can be inserted.

Thereafter, when the banknotes are inserted into the deposit and withdrawal port section 20 by the user, the banknote deposit and withdrawal device 4 detects the insertion of the banknotes by a sensor in the deposit and withdrawal port section 20, and closes the deposit and withdrawal port shutter 5.

Figure 3:
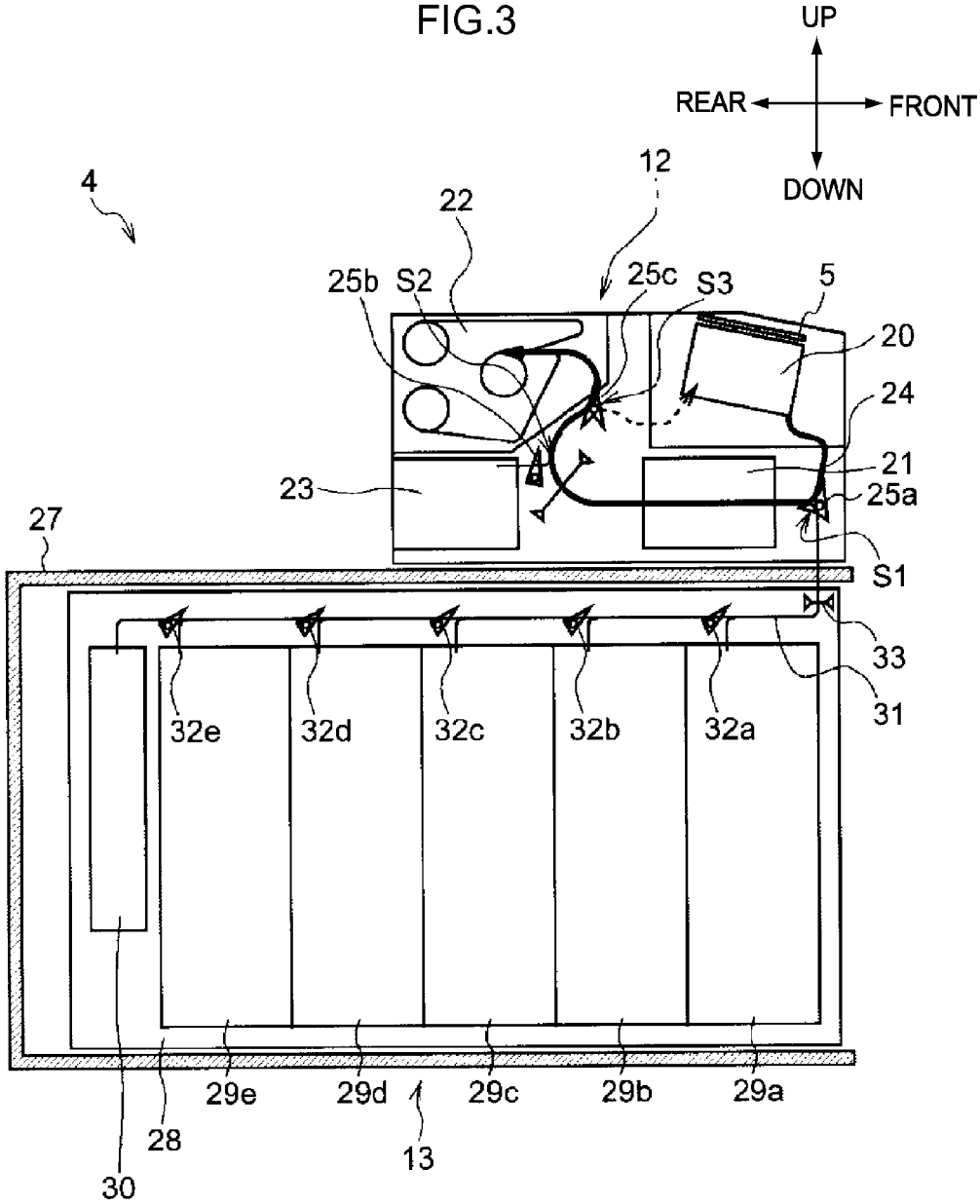
FIG. 3 is a schematic diagram to accompany explanation of an operation (deposit-count) of the banknote deposit and withdrawal device.

Thereafter, as illustrated in FIG. 3, the banknotes inserted into the deposit and withdrawal port section 20 are separated one by one, and are sent out to the upper conveyance route 24, as illustrated by a solid arrow in Figure.

At this time, the control section 10 controls the switcher 25*a* of the branching portion S1, and switches the conveying direction at the branching portion S1 rearward (the differentiating section 21 side). Thus, the banknotes are conveyed from the branching portion S1 to the differentiating section 21 at the rear side.

In the differentiating section 21, the authenticity, the deformation, the denomination, the conveying state, and the like, of the banknotes being conveyed are differentiated one by one, and the differentiation results thereof are sent to the control section 10.

The control section 10 stores, as differentiation result information at the time of deposit, the differentiation results of the respective banknotes in the memory section 11 in correspondence with the differentiated order. Furthermore, the control section 10 controls the switcher 25*c* of the branching portion S3 based on the differentiation results, and switches the conveying direction at the branching portion S3 upward (the temporary holding section 22 side) or forward (the deposit and withdrawal port section 20).

Note that, at this time, at the branching portion S2, the conveying direction is switched upward (the temporary holding section 22 side and the deposit and withdrawal port section 20 side) by the switcher 25*b*.

Actually, the banknotes, differentiated as banknotes suitable for the deposit by the differentiation of the differentiating section 21, are conveyed from the differentiating section 21 to the temporary holding section 22, and are stored in the temporary holding section 22, as illustrated by a solid arrow in Figure.

Herein, the control section 10 differentiates each denomination of the banknotes stored in the temporary holding section 22 by referring to the differentiation result information at the time of deposit stored in the memory section 11, and performs the count of the banknotes stored in the temporary holding section 22 based on the denominations thereof. Moreover, the control section 10 displays the counting result on the operation display section 6 to perform the confirmation of the deposit count result for the user.

Note that, since the order differentiated in the differentiating section 21 and the differentiation result are written in association with each other in the differentiation result information at the time of deposit for each inserted banknote, if referring to the differentiation result information at the time of deposit, it is possible to specify each denomination of the banknotes stored in the temporary holding section 22.

Meanwhile, the banknotes, differentiated as the banknotes not suitable for the deposit (deposit rejected banknotes) by the differentiation of the differentiating section 21, are conveyed from the differentiating section 21 to the deposit and withdrawal port section 20 as illustrated by a dotted arrow in Figure, and are accumulated in the deposit and withdrawal port section 20.

Herein, the banknote deposit and withdrawal device 4 opens the deposit and withdrawal port shutter 5. Accordingly, a state is obtained where the deposit rejected banknotes can be received, and the deposit rejected banknotes are returned to the user.

Note that, the banknotes not suitable for the deposit (the deposit rejected banknotes) are, for example, deformed banknotes, foreign banknotes or the like. In this connection, although counterfeit banknotes are different in countries to which the ATM 1 is provided, in the present embodiment, counterfeit banknotes are stored in the temporary holding section 22 together with the banknotes suitable for the deposit, without being returned so as not to be reused by the user.

In this manner, the banknote deposit and withdrawal device 4 performs the count of the banknotes inserted by the user, and the returns the deposit rejected banknotes.

[3-2. Storing of Banknotes at the Time of Deposit Transaction]

Thereafter, when instructions of confirming the deposit transaction are given via the operation display section 6 by the user who confirmed the deposit count result, the banknote deposit and withdrawal device 4 confirms the deposit transaction, and stores the deposited banknotes. Herein, storing of the banknotes after the confirmation of the deposit transaction will be described using FIG. 4.

Namely, the deposited banknotes, that is, the banknotes stored in the temporary holding section 22 are sent out to the upper conveyance route 24 from the finally stored banknote sequentially one by one, as illustrated by a solid arrow in Figure.

At this time, the control section 10 controls the switcher 25*c* of the branching portion S3, and switches the conveying direction at the branching portion S3 downward (the reject container 23 and the differentiating section 21 side). Thus, the banknotes are conveyed downward from the branching portion S3.

Furthermore, at this time, the control section 10 differentiates whether or not each of the banknotes sent out from the temporary holding section 22 is the banknote suitable for the withdrawal (that is, the recyclable banknote), by referring to the differentiation result information at the time of deposit stored in the memory section 11.

Note that since the order and the differentiation result differentiated in the differentiating section 21 are written in association with each other in the differentiation result information at the time of deposit, it is possible to specify the order (that is, the sending-out order) of the banknotes stored in the temporary holding section 22 and the differentiation result by referring to the differentiation result information at the time of deposit.

Herein, the control section 10 controls the switcher 25*b* of the branching portion S2 based on the differentiation result as to whether or not the banknotes are suitable for the withdrawal for each banknote sent out from the temporary holding section 22, and switches the conveying direction at the branching portion S2 downward (the differentiating section 21 side) or rearward (the reject container 23 side).

Note that, in regard to the switcher 25*a* of the branching portion 51, the conveying direction at the branching portion 51 is switched downward (the lower housing 13 side).

Actually, among the banknotes sent out from the temporary holding section 22, the banknotes differentiated as the banknotes suitable for the withdrawal are conveyed from the temporary holding section 22 to the differentiating section 21 as illustrated by a solid arrow in Figure, the denominations thereof or the like are differentiated again by the differentiating section 21, and then the banknotes are conveyed to the lower housing 13.

Herein, the control section 10 suitably controls the respective switchers 32 (31*a* to 32*e*) of the lower conveyance route 31 so that the banknotes conveyed to the lower housing 13 are conveyed to the banknote storage containers 29 (29*a* to 29*e*) corresponding to the denominations thereof, thereby switching the conveying direction.

As a result, the banknotes conveyed to the lower housing 13, that is, the banknotes differentiated as the banknotes suitable for the withdrawal, are conveyed to the banknote storage containers 29 (29*a* to 29*e*) corresponding to the denominations thereof and are stored therein.

In contrast, the banknotes differentiated as the banknotes that are not suitable for the withdrawal are directly conveyed from the temporary holding section 22 to the reject container 23 of the upper housing 12 and are stored therein, without going through the differentiating section 21, as illustrated by a dotted arrow in Figure.

Note that, herein, the banknotes that are not suitable for the withdrawal are, for example, counterfeit banknotes and the like. Since the counterfeit banknotes are stored in the temporary holding section 22 without being returned to the user as described above, at this time, the counterfeit banknotes are stored in the reject container 23 separately from other normal banknotes.

In this manner, among the banknotes stored in the temporary holding section 22 at the time of deposit transaction, the banknotes such as counterfeit banknotes that are not suitable for the withdrawal, that is, the banknotes to be stored separately from the normal banknotes, are directly stored from the temporary holding section 22 to the reject container 23 without going through the differentiating section 21.

Accordingly, for example, compared to a case of storing the banknotes in a route that necessarily goes through the differentiating section 21 as in the conventional art, it is possible to shorten the conveying distance from the temporary holding section 22 to a storing place (namely, the reject container 23), which may reduce the rate of occurrence of a failure (jam or the like) due to the banknotes to be stored separately from the normal banknotes.

In this connection, although the banknotes that are not suitable for the withdrawal are conveyed and stored to the reject container 23 of the upper housing 12 herein, for example, when the reject container 23 is full, the banknotes may be conveyed and stored to the reject container 30 of the lower housing 13.

Not limited to the above, for example, the counterfeit banknotes may be stored in the reject container 23, and the banknotes that are not suitable for the withdrawal other than the counterfeit banknotes may be stored in the reject container 30.

In this manner, the banknote deposit and withdrawal device 4 stores the deposited banknotes.

[3-3. Withdrawal of Banknotes at the Time of Withdrawal Transaction]

Figure 5:
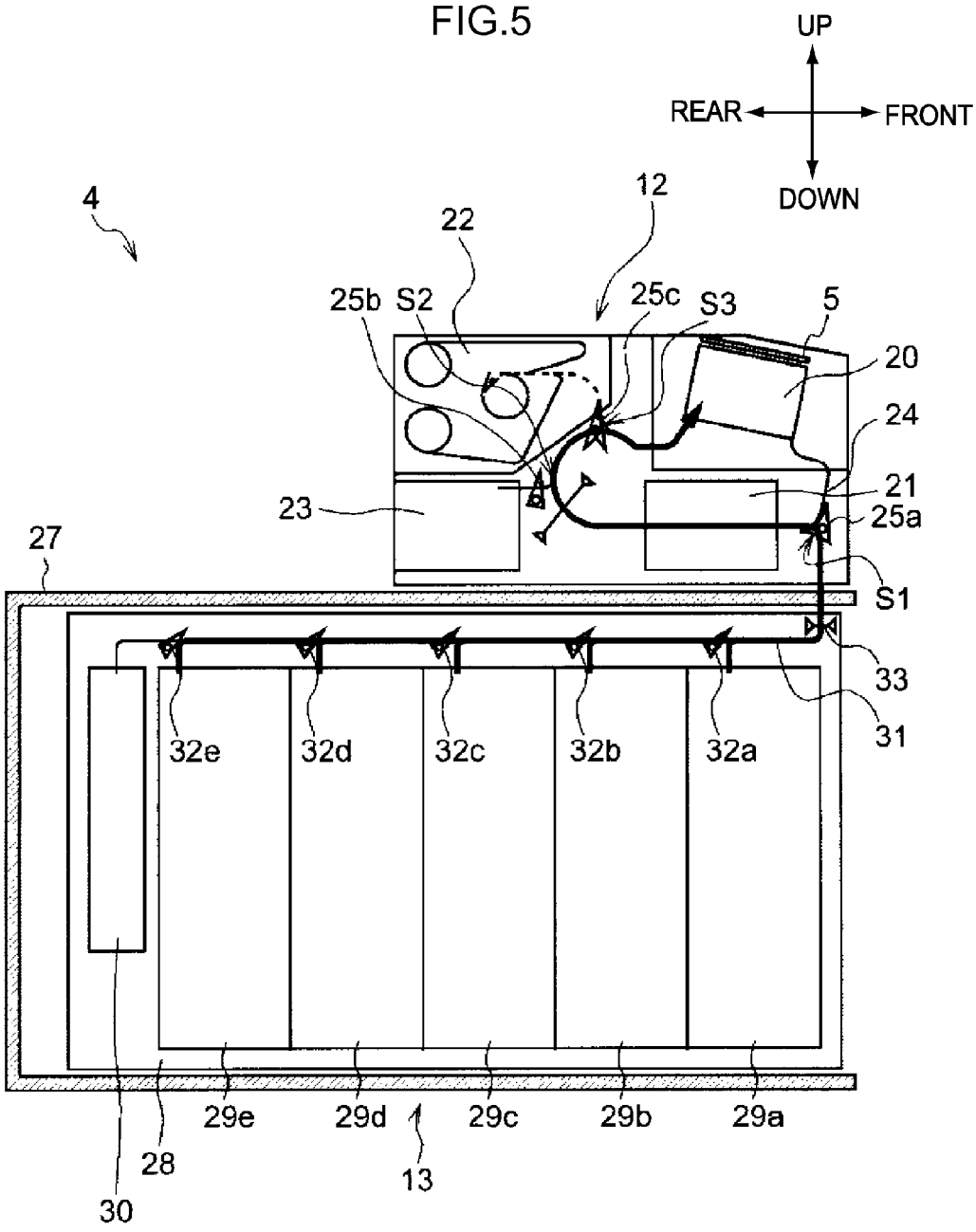
FIG. 5 is a schematic diagram to accompany explanation of an operation (withdrawal) of the banknote deposit and withdrawal device.

Next, the withdrawal of banknotes at the time of withdrawal transaction will be described using FIG. 5.

When a cash card or the like is inserted into the ATM 1 by the user, and the transaction items (in this case, withdrawal), a password, an amount of withdrawal and the like are input via the operation display section 6, the banknote deposit and withdrawal device 4 recognizes the number of banknotes for each necessary denomination corresponding to the required amount, and sends out the banknotes from the banknote storage containers 29 (29*a* to 29*d*) to the lower conveyance route 31 one by one corresponding to the number of banknotes for each denomination.

Note that, at this time, the control section 10 suitably controls the respective switchers 32 (32*a* to 32*e*) of the lower conveyance route 31 to switch the conveying direction so that the banknotes sent out from the banknote storage containers 29 (29*a* to 29*e*) to the lower conveyance route 31 are conveyed to the upper conveyance route 24.

Furthermore, at this time, at the branching portion S1 of the upper conveyance route 24, the conveying direction is switched downward (the differentiating section 21 side) by the switcher 25*a*.

Thus, the banknotes, sent out from the respective banknote storage containers 29 (29*a* to 29*e*) to the lower conveyance route 31 one by one, are conveyed to the upper conveyance route 24 and are further conveyed to the differentiating section 21.

The differentiating section 21 differentiates the authenticity, the deformation, the denomination, the conveying state and the like of the conveyed banknotes one by one, and sends the differentiation results thereof to the control section 10.

The control section 10 stores, as differentiation result information at the time of withdrawal, the differentiation results of each banknote and the differentiated order, which are associated with each other, in the memory section 11. Furthermore, the control section 10 controls the switcher 25*c* of the branching portion S3 based on the differentiation result, and switches the conveying direction at the branching portion S3 upward (the temporary holding section 22 side) or forward (the deposit and withdrawal port section 20 side).

Note that, at this time, at the branching portion S2, the conveying direction is switched upward (the temporary holding section 22 side and the deposit and withdrawal port section 20 side) by the switcher 25*b*.

Actually, the banknotes differentiated as the banknotes suitable for the withdrawal by the differentiation of the differentiating section 21 are conveyed from the differentiating section 21 to the deposit and withdrawal port section 20, and are accumulated in the deposit and withdrawal port section 20, as illustrated by a solid arrow in Figure.

Meanwhile, the banknotes differentiated as the banknotes (the withdrawal rejected banknotes) that are not suitable for the withdrawal by the differentiation of the differentiating section 21 are conveyed from the differentiating section 21 to the temporary holding section 22 and are stored in the temporary holding section 22, as illustrated by a dotted arrow in Figure.

When the banknotes of the withdrawal amount are accumulated in the deposit and withdrawal port section 20, the banknote deposit and withdrawal device 4 opens the deposit and withdrawal port shutter 5. Thus, the banknotes accumulated in the deposit and withdrawal port section 20 (that is, the withdrawal banknotes) can be received, and the user receives the banknotes.

In this manner, the banknote deposit and withdrawal device 4 performs the withdrawal of the banknotes.

[3-4. Taking-in of Banknotes at the Time of Deposit Transaction and at the Time of Withdrawal Transaction]

Next, taking-in of the banknotes at the time of deposit transaction and at the time of withdrawal transaction will be described. First, taking-in of the banknotes which are left behind will be described.

The left behind banknotes are the banknotes that the user has forgotten to take among the deposit rejected banknotes returned to the deposit and withdrawal port section 20 at the time of deposit transaction, and the banknotes that the user forgot to take among the withdrawal banknotes accumulated in the deposit and withdrawal port section 20 at the time of withdrawal transaction.

After the deposit rejected banknotes are returned to the deposit and withdrawal port section 20 at the time of deposit transaction, or after the withdrawal banknotes are accumulated in the deposit and withdrawal port section 20 at the time of withdrawal transaction, when the banknotes are not pulled out of the deposit and withdrawal port section 20 within a specified time, the banknote deposit and withdrawal device 4 closes the deposit and withdrawal port shutter 5.

Figure 6:
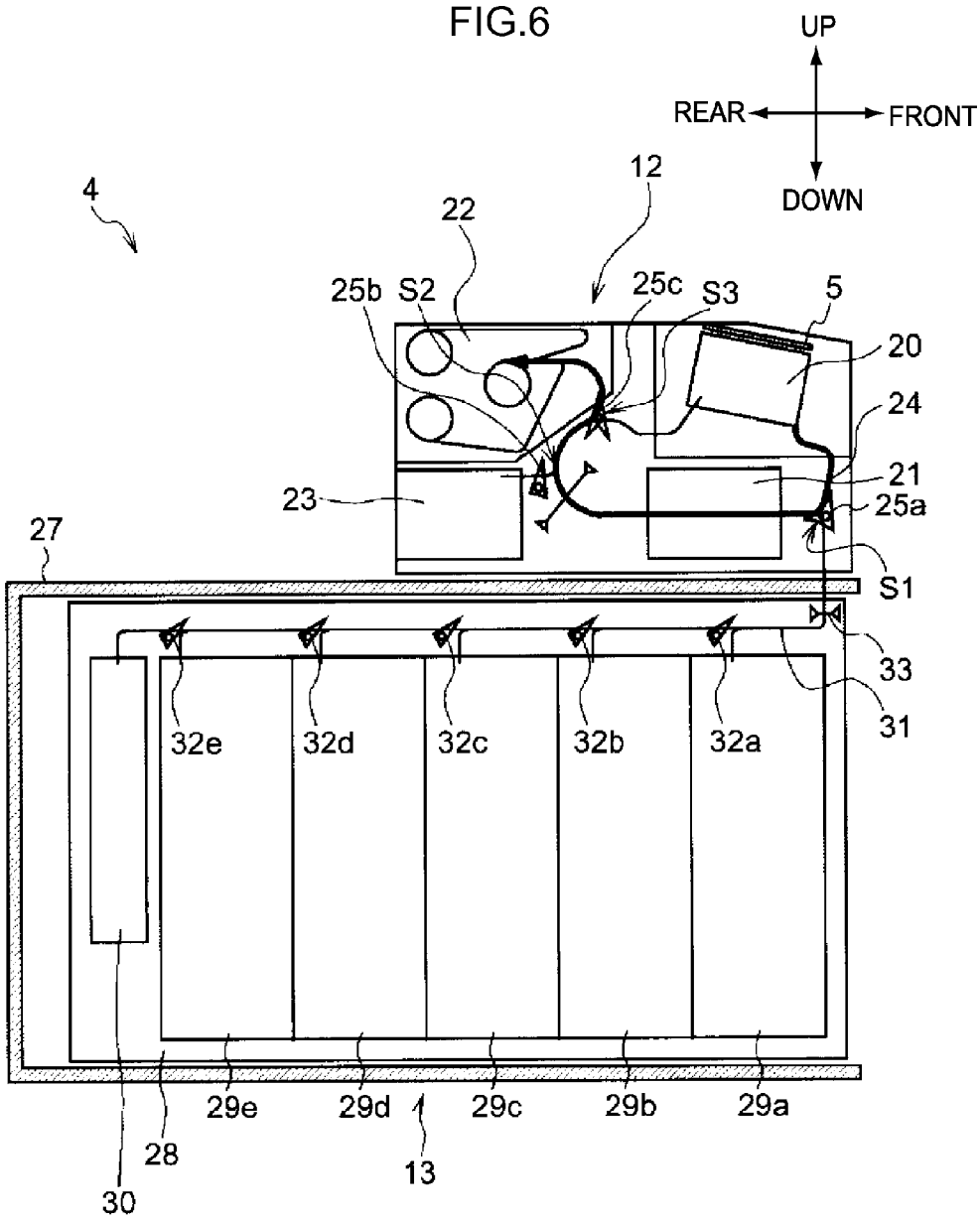
FIG. 6 is a schematic diagram to accompany explanation of an operation (taking-in 1) of the banknote deposit and withdrawal device.

Thereafter, as illustrated in FIG. 6, the banknotes remained in the deposit and withdrawal port section 20 (that is, the left behind banknotes) are separated one by one, and are sent to the upper conveyance route 24 as illustrated by a solid arrow in Figure.

At this time, the control section 10 controls the respective switchers 25*a* to 25*c* so that the conveying direction of the branching portion S1 is directed rearward (the differentiating section 21 side), the conveying direction of the branching portion S2 is directed upward (the temporary holding section 22 and the deposit and withdrawal port section 20 side), and the conveying direction of the branching portion S3 is directed upward (the temporary holding section 22 side).

Accordingly, the banknotes are first conveyed to the differentiating section 21 and are differentiated therein. The differentiating section 21 also sends the differentiation result of this time to the control section 10.

The control section 10 stores, as differentiation result information at the time of taking-in, the differentiation results of each banknote and the differentiated order, which are associated with each other, in the memory section 11.

The banknotes differentiated by the differentiating section 21 are then conveyed to the temporary holding section 22 and are stored in the temporary holding section 22. In this manner, the left behind banknotes are once stored in the temporary holding section 22.

Figure 7:
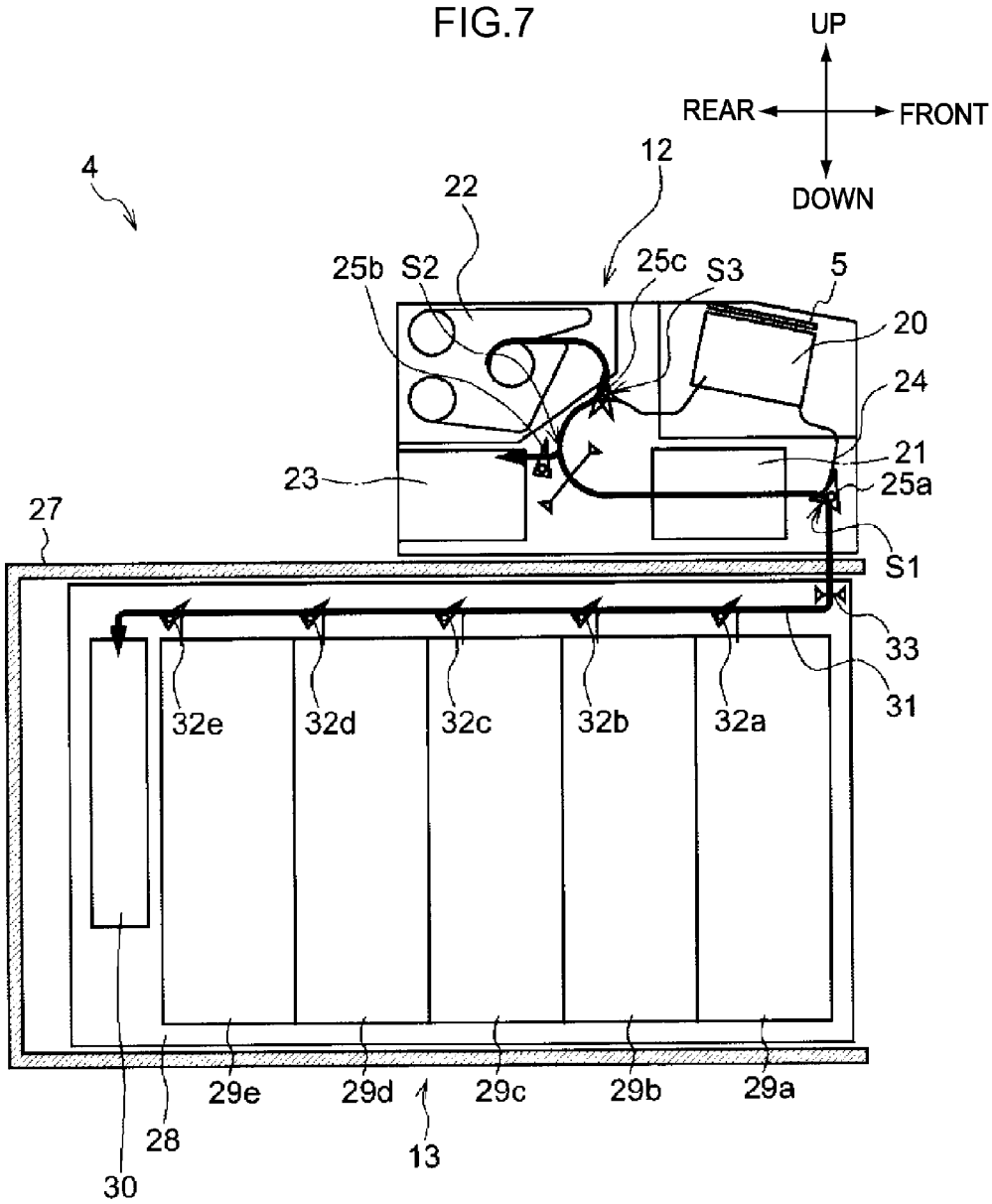
FIG. 7 is a schematic diagram to accompany explanation of an operation (taking-in 2) of the banknote deposit and withdrawal device.

When storing into the temporary holding section 22 is completed, as illustrated in FIG. 7, the banknotes stored in the temporary holding section 22 are sent out to the upper conveyance route 24 sequentially one by one from the banknote stored in last.

At this time, the control section 10 controls the switchers 25*c* and 25*b* so that the conveying direction of the branching portion S3 is directed downward (the reject container 23 side) and the conveying direction of the branching portion S2 is directed rearward (the reject container 23 side).

Accordingly, the left behind banknotes are conveyed from the temporary holding section 22 to the reject container 23 and are stored therein, as illustrated by a solid arrow in Figure.

Herein, the left behind banknotes, namely, the banknotes to be stored separately from the normal banknotes are also directly stored from the temporary holding section 22 to the reject container 23 without going through the differentiating section 21.

Therefore, for example, compared to the conventional art, it is possible to shorten the conveying distance of the banknotes (in this case, the left behind banknotes) to be stored separately from the normal banknotes, and the rate of occurrence of a failure due to the banknotes may be reduced.

Note that, although the left behind banknotes are conveyed to the reject container 23 of the upper housing 12 and stored therein, for example, when the reject container 23 is full, the left behind banknotes may be conveyed to the reject container 30 of the lower housing 13 and stored therein.

Furthermore, not limited to the above, for example, the control section 10 may store the left behind banknotes differentiated as the counterfeit banknotes in the reject container 23, and may store the left behind banknotes but not counterfeit banknotes in the reject container 30, by referring to the differentiation result information at the time of taking-in.

In this manner, the banknote deposit and withdrawal device 4 performs taking-in of the left behind banknotes.

Next, taking-in of the withdrawal rejected banknotes will be described. As described in FIG. 5, the withdrawal rejected banknotes are stored in the temporary holding section 22 at the time of withdrawal transaction.

For example, when the withdrawal transaction is completed, the banknote deposit and withdrawal device 4 performs taking-in of the withdrawal rejected banknotes stored in the temporary holding section 22.

Figure 8:
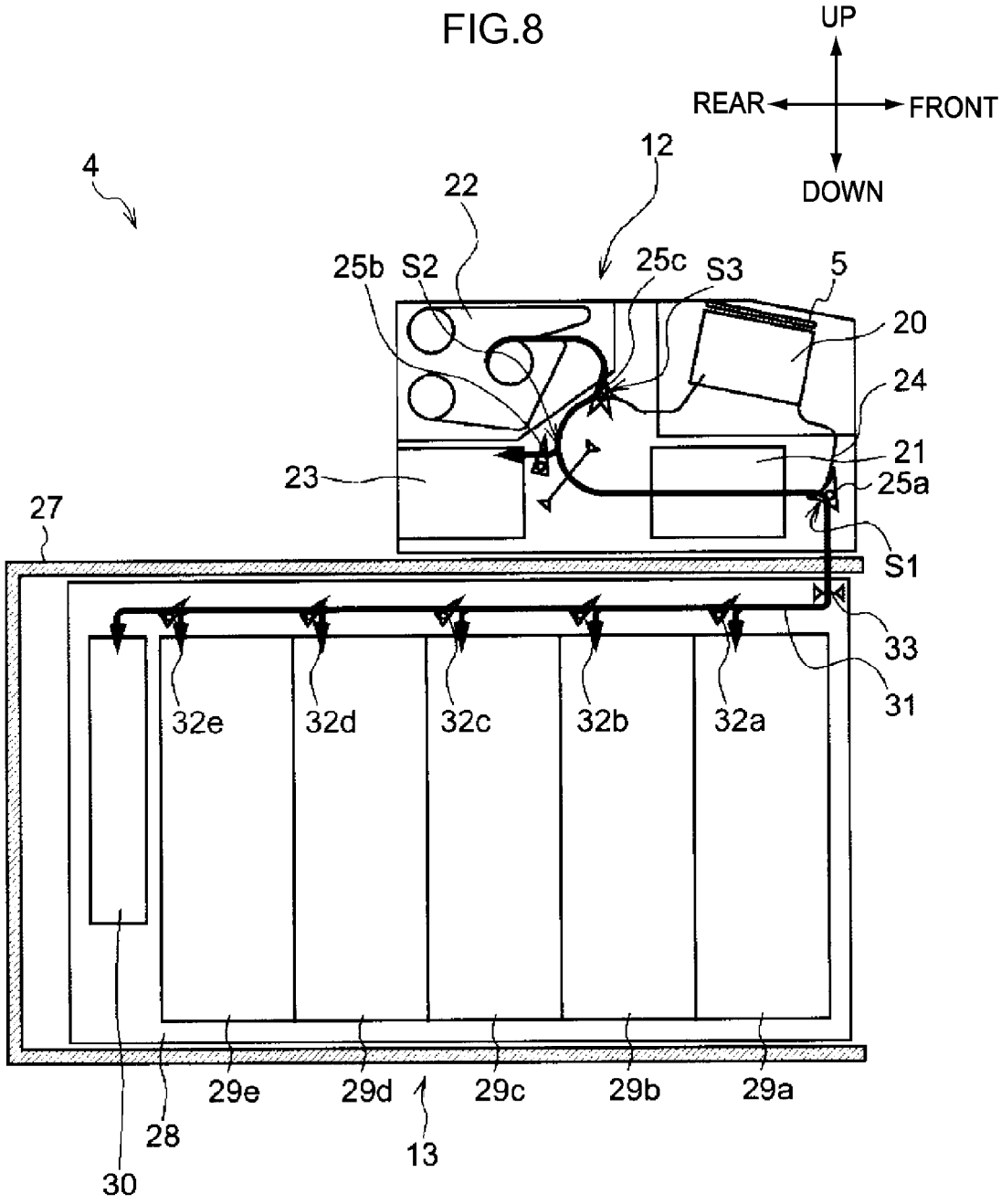
FIG. 8 is a schematic diagram to accompany explanation of an operation (taking-in 3) of the banknote deposit and withdrawal device.

Namely, as illustrated in FIG. 8, the withdrawal rejected banknotes stored in the temporary holding section 22 are sent out to the upper conveyance route 24 sequentially one by one from the banknote stored in last.

Herein, when the banknote deposit and withdrawal device 4 is set to reuse the withdrawal rejected banknotes, the control section 10 controls the switchers 25*c* and 25*b* so that the conveying direction of the branching portion S3 is directed downward (the reject container 23 and the differentiating section 21 side) and the conveying direction of the branching portion S2 is directed downward (the differentiating section 21 side).

Thus, the withdrawal rejected banknotes sent out from the temporary holding section 22 are conveyed to the differentiating section 21 and are differentiated as illustrated by a solid arrow in Figure.

Herein, the banknotes differentiated as the banknotes suitable for the withdrawal by the differentiation of the differentiating section 21 are conveyed to the banknote storage containers 29 (29*a* to 29*e*) corresponding to the denominations thereof, and are stored therein, by the same operation as storing at the time of deposit transaction.

In contrast, the banknotes differentiated as the banknotes that are not suitable for the withdrawal again by the differentiation of the differentiating section 21 are conveyed from the differentiating section 21 to the reject container 30 of the lower housing 13, and are stored in the reject container 30.

Meanwhile, when the banknote deposit and withdrawal device 4 is set so as not to reuse the withdrawal rejected banknotes, the control section 10 controls the switchers 25*c* and 25*b* so that the conveying direction of the branching portion S3 is directed downward (the reject container 23 and the differentiating section 21 side), and the conveying direction of the branching portion S2 is directed rearward (the reject container 23 side).

Thus, the withdrawal rejected banknotes sent out from the temporary holding section 22 are conveyed to the reject container 23 and are stored in the reject container 23.

Herein also, the withdrawal rejected banknotes, which are set to be stored separately from the normal banknotes, are directly stored from the temporary holding section 22 to the reject container 23, without going through the differentiating section 21.

Therefore, for example, compared to the conventional art, it is possible to shorten the conveying distance of the banknotes (in this case, the withdrawal rejected banknotes) to be stored separately from the normal banknotes, and the rate of occurrence of a failure due to such banknotes may be reduced.

Note that, in this case, for example, when the reject container 23 is full, the withdrawal rejected banknotes may also be conveyed to the reject container 30 of the lower housing 13 and stored therein.

In this manner, the banknote deposit and withdrawal device 4 performs taking-in of the withdrawal rejected banknotes.

Note that, taking-in of the banknotes is also performed at the time of recovery operation of the banknote deposit and withdrawal device 4 performed when a failure such as a jam occurs.

In this case, the banknotes remaining in the deposit and withdrawal port section 20 are taken by the same operation as taking-in of the left behind banknotes mentioned above, and the banknotes remaining in the temporary holding section 22 are taken by the same operation of taking-in of the withdrawal rejected banknotes mentioned above.

[3-5. Return of Banknotes at the Time of Deposit Transaction]

Next, at the time of deposit transaction, the return of the banknotes when cancellation of the deposit is instructed by the user will be described.

When the instruction of cancelling the deposit is given via the operation display section 6 at a stage before confirmation the deposit transaction at the time of deposit transaction, the banknote deposit and withdrawal device 4 performs the return of the inserted banknotes.

Figure 4:
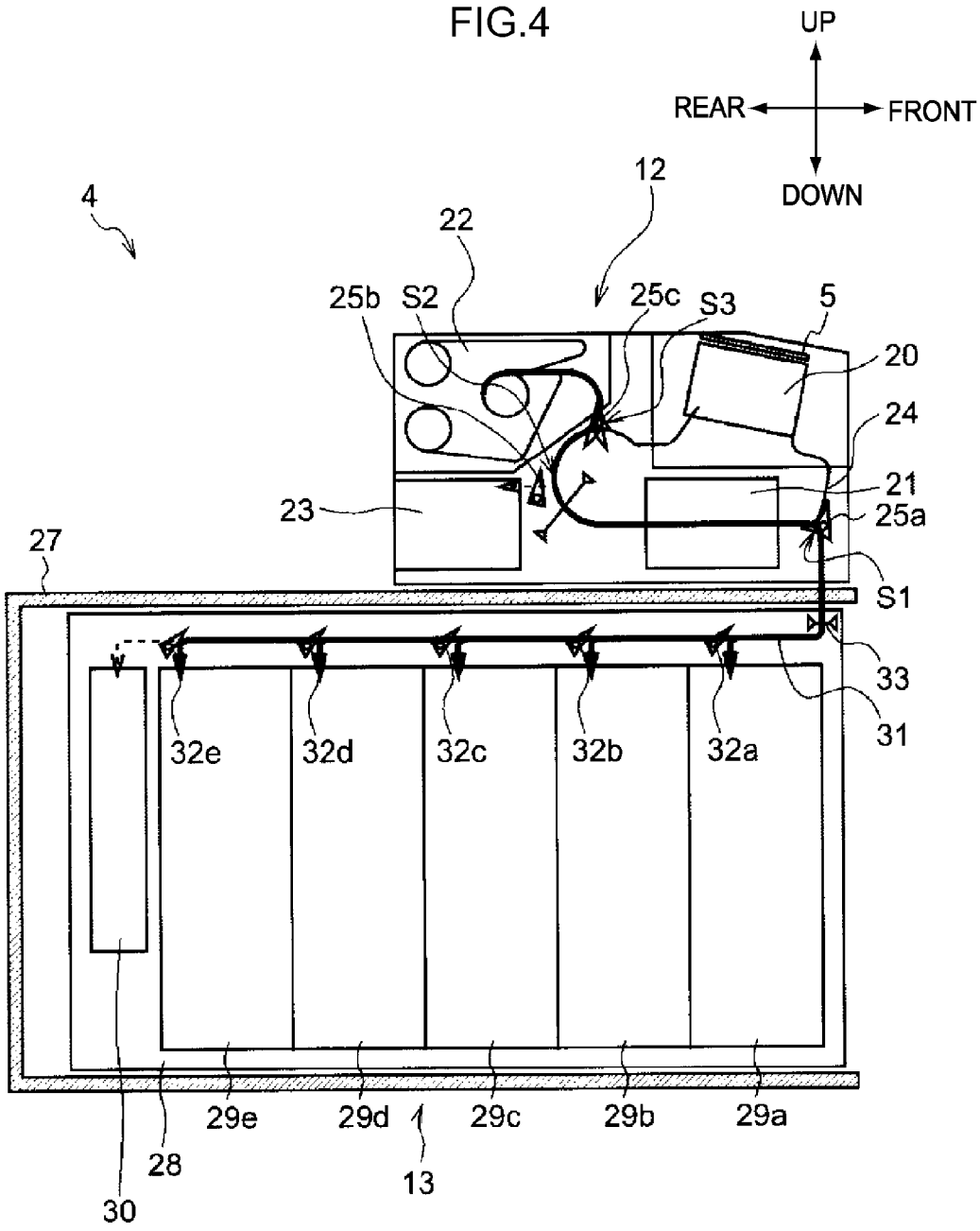
FIG. 4 is a schematic diagram to accompany explanation of an operation (deposit-storing) of the banknote deposit and withdrawal device.

As described in FIG. 4, the banknotes inserted into the deposit and withdrawal port section 20 by the user are stored in the temporary holding section 22. Thus, the banknotes stored in the temporary holding section 22 are returned.

Figure 9:
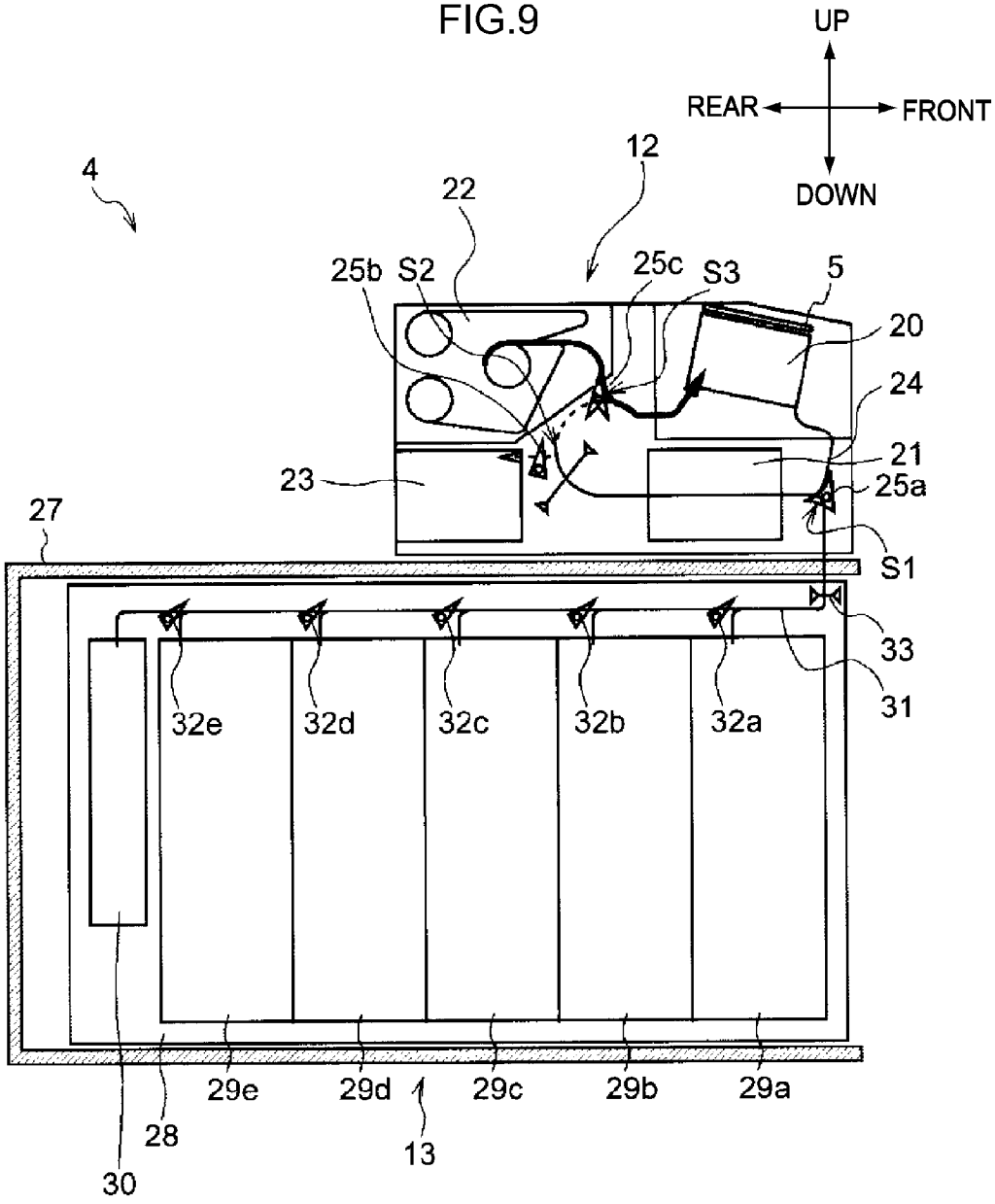
FIG. 9 is a schematic diagram to accompany explanation of an operation (return) of the banknote deposit and withdrawal device.

Namely, the banknotes stored in the temporary holding section 22 are sent out to the upper conveyance route 24 sequentially one by one from the finally stored banknote, as illustrated in FIG. 9.

At this time, the control section 10 differentiates whether or not each of the banknotes sent out from the temporary holding section 22 is returnable banknote, by referring to the differentiation result information at the time of deposit stored in the memory section 11.

Herein, the control section 10 controls the switcher 25*c* of the branching portion S3, based on the differentiation result as to whether or not the banknotes are returnable banknotes for each banknote sent out from the temporary holding section 22, thereby switching the conveying direction at the branching portion S3 downward (the reject container 23 and the differentiating section 21 side) or forward (the deposit and withdrawal port section 20 side).

Note that, in regard to the switcher 25*b* of the branching portion S2, the conveying direction at the branching portion S2 is switched rearward (the reject container 23 side).

Actually, among the banknotes sent out from the temporary holding section 22, the banknotes differentiated as the returnable banknotes are conveyed from the temporary holding section 22 to the deposit and withdrawal port section 20, and are returned to the user by opening the deposit and withdrawal port shutter 5, as illustrated by a solid arrow in the Figure.

In contrast, the banknotes differentiated as the non-returnable banknotes are conveyed from the temporary holding section 22 to the reject container 23 and are stored therein, as illustrated by a dotted arrow in the Figure.

Note that, the non-returnable banknotes described here are, for example, counterfeit banknotes and the like. The counterfeit banknotes are stored in the reject container 23 without being returned so as not to be reused by the user, as described above.

Herein also, the banknotes such as counterfeit banknotes, that is, the banknotes to be stored separately from the normal banknotes are directly stored from the temporary holding section 22 to the reject container 23, without going through the differentiating section 21.

Therefore, for example, compared to the conventional art, it is possible to shorten the conveying distance of the banknotes to be stored separately from the normal banknotes (for example, counterfeit banknotes), and the rate of occurrence of a failure due to such banknotes may be reduced.

In this manner, the banknote deposit and withdrawal device 4 performs the return of the banknotes when the cancellation of the deposit is instructed by the user.

[4. Summary]

As described hereinbefore, the control section 10 of the banknote deposit and withdrawal device 4 stores results of differentiation performed by the differentiating section 21 at a previous stage where the banknotes are stored in the temporary holding section 22, as the differentiation result information.

Thereafter, when sending out the banknotes stored in the temporary holding section 22, the control section 10 differentiates whether the banknotes stored in the temporary holding section 22 are the normal banknotes or the banknotes to be stored separately from the normal banknotes, respectively, based on the differentiation result information.

Moreover, the control section 10 directly conveys and stores the banknotes, which are differentiated as the banknotes to be stored separately from the normal banknotes, from the temporary holding section 22 to the reject container 23, without going through the differentiating section 21.

In this manner, for example, compared to a case of conveying the banknotes in the route that all ways goes through the differentiating section 21 as in the conventional art, as the banknotes are directly conveyed from the temporary holding section 22 to the storing place (that is, the reject container 23), the banknote deposit and withdrawal device 4 may shorten the conveying distance from the temporary holding section 22 to the storing place (the reject container 23), and may reduce the rate of occurrence of a failure (jam or the like) due to the banknotes to be stored separately from the normal banknotes.

Further, in this manner, a situation that the counterfeit banknotes to be stored separately from the normal banknotes are jammed during conveying, and becoming indistinguishable from the normal banknotes, may be avoided as much as possible.

Furthermore, the banknote deposit and withdrawal device 4 sets the conveying distance from the temporary holding section 22 to the reject container 23 at a necessary minimum distance by disposing the reject container 23, which is configured to store the banknotes to be stored separately from the normal banknotes, so as to be adjacent to the temporary holding section 22, and due thereto, may further reduce the rate of occurrence of a failure (jam or the like) during conveying from the temporary holding section 22 to the reject container 23.

According to the above configuration, the banknote deposit and withdrawal device 4 may reduce the rate of occurrence of a failure due to the banknotes to be stored separately from the normal banknotes compared to the conventional art, and may further reduce the rate of occurrence of a failure compared to the conventional art.

[5. Other Embodiments]

[5-1. Another Embodiment 1]

Note that, in the above-mentioned embodiment, one reject container 23 was provided in the upper housing 12 of the banknote deposit and withdrawal device 4, and one reject container 30 was provided in the lower housing 13 thereof.

Figure 10:
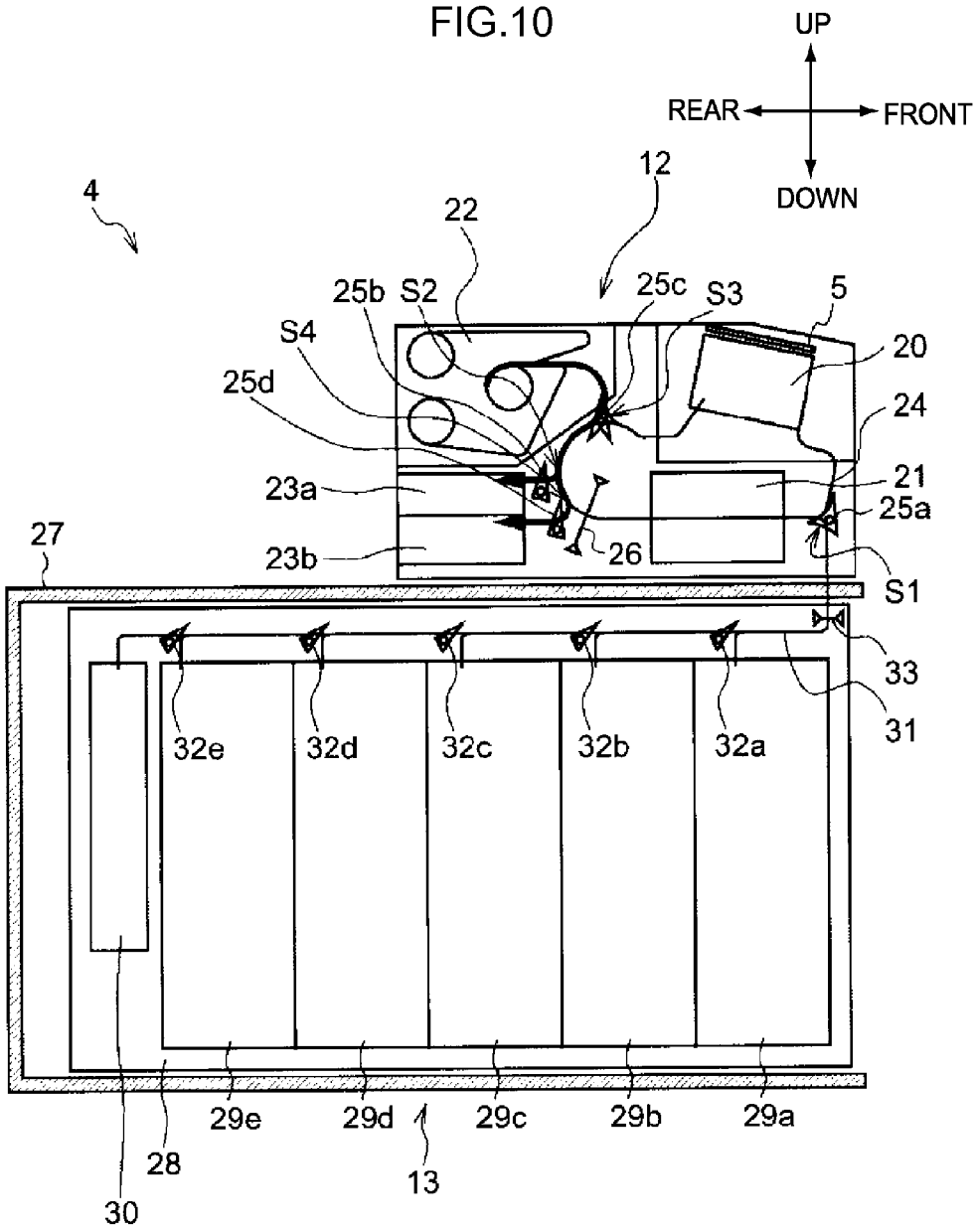
FIG. 10 is a schematic diagram that illustrates a configuration (1) of a banknote deposit and withdrawal device in another embodiment.

Not limited to the above, and the number of the reject containers 23 and 30 may be two or more. For example, as illustrated in FIG. 10, two reject containers 23*a* and 23*b* may be provided in the upper housing 12.

In this case, for example, the reject container 23*a* is disposed adjacent to the bottom of the temporary holding section 22, and further, the reject container 23*b* is disposed adjacent to the bottom of the reject container 23*a*.

Herein, the upper reject container 23*a* is connected to a portion of the upper conveyance route 24 branched rearward from the branching portion S2, similarly to the reject container 23 of the above-mentioned embodiment.

On the other hand, the lower reject container 23*b* is connected to a portion of the upper conveyance route 24 branched rearward from the branching portion S4 below the branching portion S2. Further, a switcher 25*d* is also provided in the branching portion S4.

Moreover, for example, the banknotes to be stored separately from the normal banknotes are first stored in the upper reject container 23*a*, and when the reject container 23*a* is full, the banknotes are stored in the lower reject container 23*b*.

Furthermore, not limited to the above, and for example, the banknotes stored in the upper reject container 23*a* and the lower reject container 23*b* may be distinguished from each other, by storing the counterfeit banknotes in the upper reject container 23*a* and by storing the banknotes to be stored separately from the normal banknotes other than the counterfeit banknotes in the lower reject container 23*b*.

[5-2. Another Embodiment 2]

Furthermore, in the above-mentioned embodiment, the reject container 23 was provided below the temporary holding section 22 of the upper housing 12 of the banknote deposit and withdrawal device 4, and the reject container 30 was provided behind the banknote storing section 28 of the lower housing 13.

Figure 11:
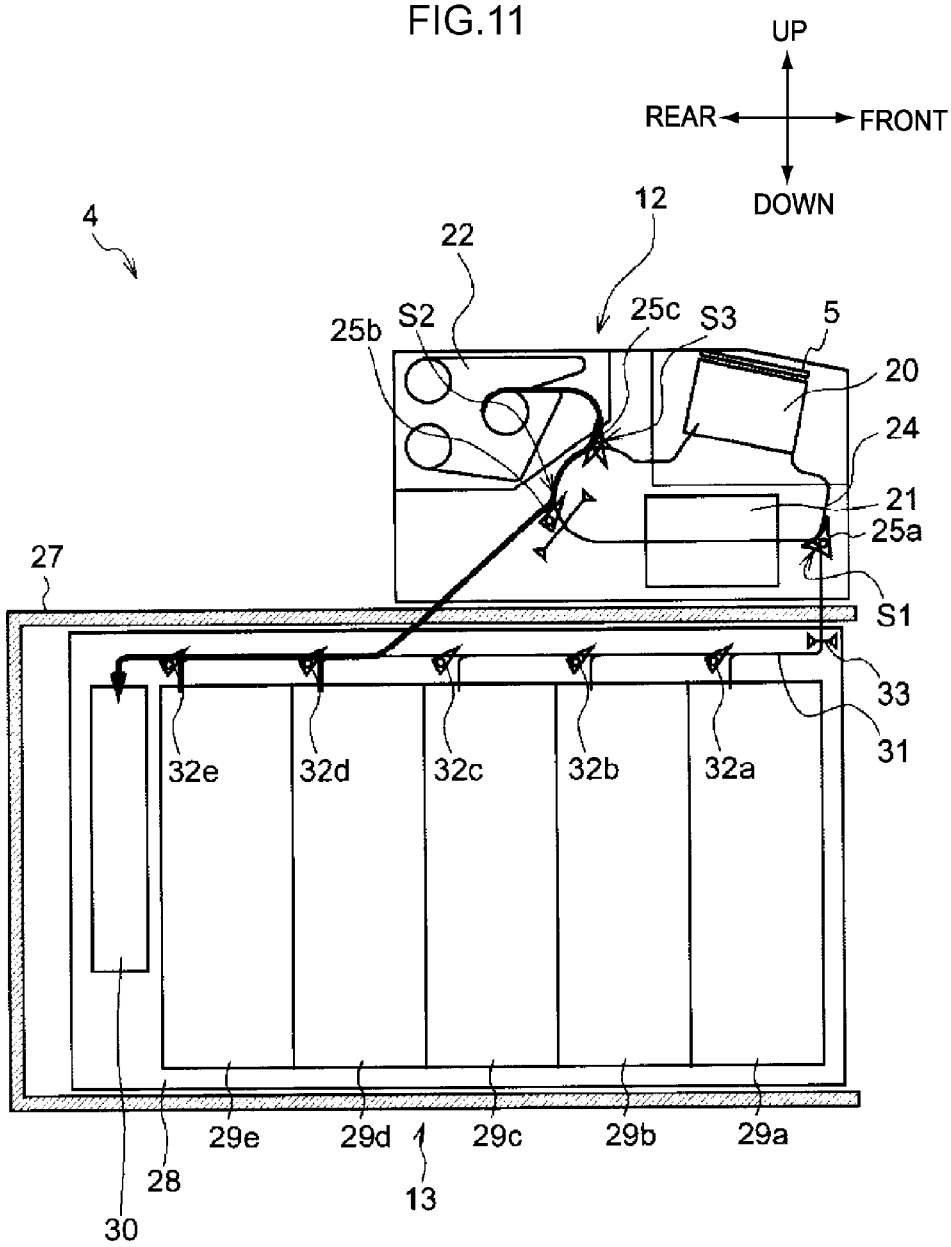
FIG. 11 is a schematic diagram that illustrates a configuration (2) of a banknote deposit and withdrawal device in another embodiment.

Not limited to the above, and for example, as illustrated in FIG. 11, the reject container 30 may be provided only behind the banknote storing section 28 of the lower housing 13, by excluding the reject container 23 of the upper housing 12.

In this case, the upper conveyance route 24 branches obliquely rearward and downward at the branching portion S2, and a portion branched obliquely rearward and downward extends to the lower conveyance route 31, and is connected to the lower conveyance route 31 as it is.

Moreover, the banknotes to be stored separately from the normal banknotes are directly conveyed to the reject container 30 through the portion extending obliquely rearward and downward from the branching portion S2, without going through the differentiating section 21 from the temporary holding section 22.

In this case, for example, compared to a case of conveying the banknotes in the route that necessarily goes through the differentiating section 21 as in the conventional art, as the banknotes are directly conveyed from the temporary holding section 22 to the storing place (the reject container 30), it may shorten the conveying distance from the temporary holding section 22 to the storing place (the reject container 30), which may reduce the rate of occurrence of a failure (jam or the like) due to the banknotes to be stored separately from the normal banknotes.

[5-3. Another Embodiment 3]

Further, in the above-mentioned embodiment, the banknote storing section 28 of the lower housing 13 was provided as a so-called horizontal type banknote storing section in which plural vertical banknote storing storages 29 (29*a* to 29*e*) are disposed in the horizontal direction (front-back direction).

Figure 12:
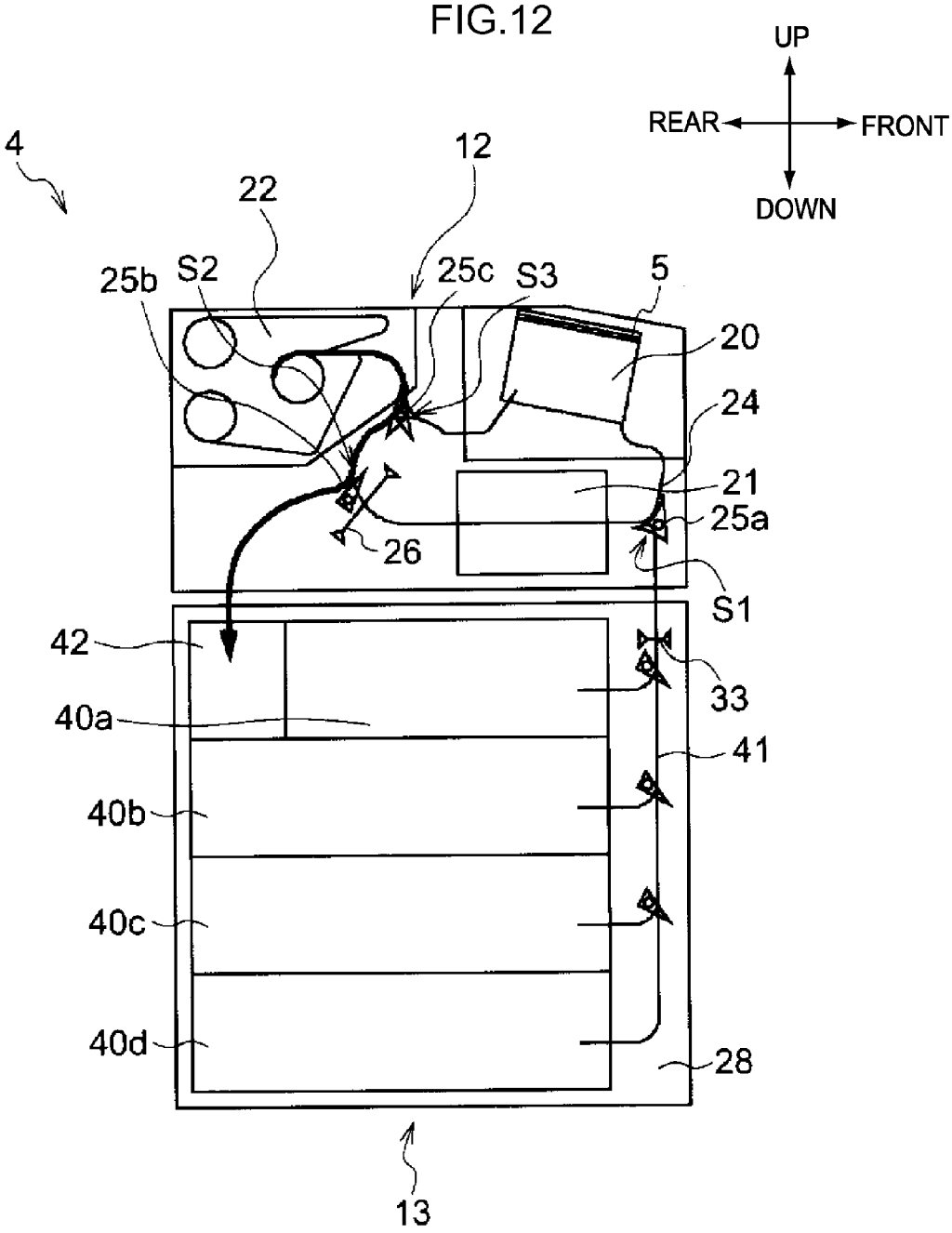
FIG. 12 is a schematic diagram that illustrates a configuration (3) of a banknote deposit and withdrawal device in another embodiment.
Figure 13:
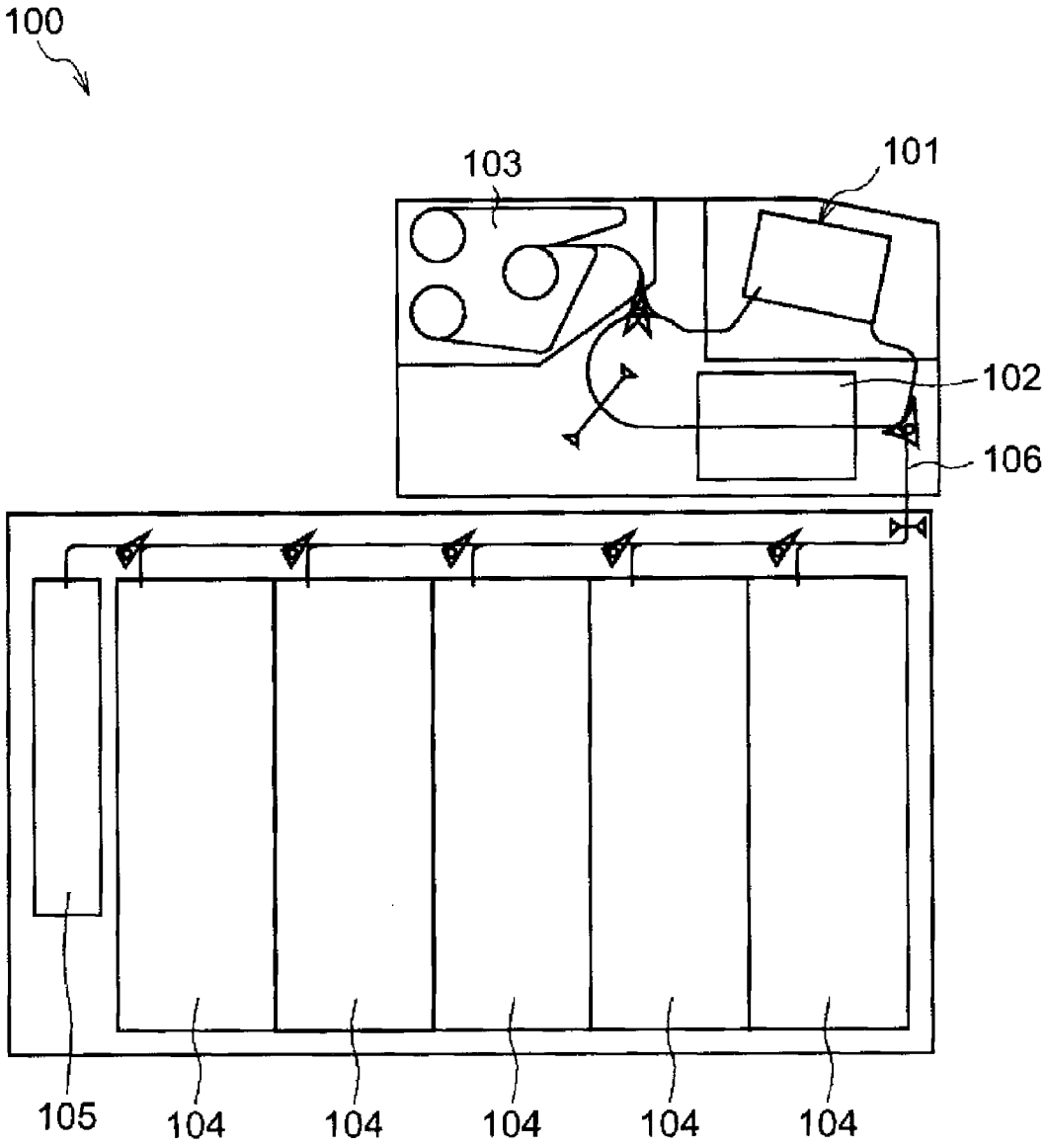
FIG. 13 is a schematic diagram that illustrates a configuration of a conventional banknote deposit and withdrawal device.

Not limited to the above, and for example, as illustrated in FIG. 12, the banknote storing section 28 of the lower housing 13 may be provided as a so-called vertical type banknote storing section in which plural horizontal banknote storing storages 40 (40*a* to 40*d*) are disposed in the vertical direction (up-down direction). Note that, although not illustrated in the drawings, the lower housing 13 also has a configuration in which the banknote storing section 28 is provided inside the safe housing.

In this case, in the banknote storing section 28, a lower conveyance route 41 extending in the up-down direction is provided ahead of the four banknote storage containers 40 (40*a* to 40*d*).

The lower conveyance route 41 is connected to the four banknote storage containers 40 (40*a* to 40*d*), extends upward, and is connected to the upper conveyance route 24.

Furthermore, the banknote storing section 28 is configured so that the depth of the uppermost banknote storage container 40*a* may be shorter than the other banknote storage containers 40*b* to 40*d* and a reject container 42 may be provided in this space.

On the other hand, the upper housing 12 has a configuration in which the reject container 23 is excluded, the upper conveyance route 24 branches obliquely rearward and downward at the branching portion S2, and the portion branched obliquely rearward and downward extends to the reject container 42 and is connected to the reject container 42 as it is.

Moreover, in this case, the banknotes to be stored separately from the normal banknotes are also directly conveyed to the reject container 42 through the portion extending obliquely rearward and downward from the branching portion S2, without going through the differentiating section 21 from the temporary holding section 22, as illustrated by a solid arrow in Figure.

In this case, for example, compared to a case of conveying the banknotes in the route that necessarily goes through the differentiating section 21 as in the conventional art, as the banknotes are also directly conveyed from the temporary holding section 22 to the storing place (that is, the reject container 42), it may shorten the conveying distance from the temporary holding section 22 to the storing place (the reject container 42), which may reduce the rate of occurrence of a failure (jam or the like) due to the banknotes to be stored separately from the normal banknotes.

[5-4. Another Embodiment 4]

Furthermore, in the above-mentioned embodiments, although the present invention has been applied, but not limited, to the banknote deposit and withdrawal device 4 provided in the ATM 1, the present invention may be applied to other types of devices as long as the devices carry the banknotes, which need to be stored separately from the normal banknotes, from the temporary holding section to the storing place, and store the banknotes therein.

Furthermore, in the above-mentioned embodiments, although the present invention has been applied, but not limited, to the ATM 1 as the banknote processing device, the present invention may be applied to other types of devices as long as the devices include the banknote deposit and withdrawal device configured to carry and store the banknotes, which need to be stored separately from the normal banknotes, from the temporary holding section to the storing place.

[5-5. Another Embodiment 5]

Furthermore, the present invention is not limited to the above-mentioned embodiment and the above-mentioned other embodiments. Namely, the coverage of the present invention also extends to embodiments obtained by arbitrary combination with a part or all of the above-mentioned embodiment and the above-mentioned other embodiments, and embodiments obtained by extracting a part thereof.

Industrial Applicability

The present invention may be widely used in devices such as an ATM that handles the banknotes.

The invention claimed is:

1. A banknote processing device comprising:

an upper housing;

a lower housing;

a differentiating section, provided within the upper housing, that determines differentiation results to differentiate between a plurality of banknotes to determine suitable banknotes of the plurality of banknotes that are each suitable for withdrawal, counterfeit banknotes of the plurality of banknotes that are each counterfeit, and unsuitable banknotes of the plurality of banknotes that are each both not counterfeit and not suitable for withdrawal;

a temporary holding section, provided in the upper housing, that temporarily stores the suitable, counterfeit and unsuitable banknotes differentiated by the differentiating section;

a plurality of banknote storage containers;

a first reject container provided within the upper housing;

a second reject container provided within the lower housing; and a conveyance route that connects the differentiating section, the temporary holding section, the first reject container, the second reject container and the plurality of banknote storage containers, wherein the suitable, counterfeit and unsuitable banknotes stored in the temporary holding section are sent out to be stored in the plurality of banknote storage containers, the first reject container and the second reject container based on the differentiation results so that the suitable, counterfeit and unsuitable banknotes are conveyed such that the suitable banknotes are conveyed from the temporary holding section to the plurality of banknote storage containers via the differentiating section so that the plurality of banknote storage containers receives and stores the suitable banknotes, the counterfeit banknotes are conveyed from the temporary holding section to the first reject container via a route that does not go through the differentiating section so that the first reject container receives and stores the counterfeit bills, and the unsuitable banknotes are conveyed from the temporary holding section to the second reject container via the differentiating section so that the second reject container receives and stores the unsuitable banknotes.

2. The banknote processing device according to claim 1, wherein after a deposit of the plurality of the banknotes is confirmed, the counterfeit banknotes are conveyed from the temporary holding section to be stored in the first reject container, and the unsuitable banknotes are conveyed from the temporary holding section to be stored in the second reject container.

3. The banknote processing device according to claim 1, wherein the first reject container only stores counterfeit banknotes.

4. The banknote processing device according to claim 1, wherein the first and second reject containers are completely separate from each so as to be free of any direct contact with each other.

5. The banknote processing device according to claim 1, wherein the first reject container is disposed adjacent to the temporary holding section.

6. The banknote processing device according to claim 5, wherein the temporary holding section temporarily stores left behind banknotes that have been left behind in a banknote deposit and withdrawal port section, and after the suitable, counterfeit and unsuitable banknotes are sent out from the temporary holding section, the left behind banknotes are conveyed, via the route that does not go through the differentiating section, and are stored in the first reject container.

7. The banknote processing device according to claim 5, wherein, at a time of a deposit transaction, the temporary holding section temporarily stores temporary banknotes that are inserted from a deposit and withdrawal port section, the differentiating section determining differentiation results to differentiate between the temporary banknotes, and when the deposit transaction is cancelled before confirmation of deposit, returnable banknotes of the temporary banknotes stored, that are in the temporary holding section and are differentiated as being returnable based on the differentiation results of the temporary banknotes, are returned to the deposit and withdrawal port section, non-returnable banknotes of the temporary banknotes, that are stored in the temporary holding section and are differentiated as being non-returnable based on the differentiation results of the temporary banknotes, are conveyed from the temporary holding section, via the route that does not go through the differentiating section, and are stored in the first reject container.

8. The banknote processing device according to claim 5, further comprising:

a control section; and a memory section, wherein the control section stores, in the memory section, differentiation result information that indicates differentiation results of a group of banknotes by the differentiating section, and when the group of banknotes stored in the temporary holding section are sent out to be stored in the plurality of banknote storage containers, the first reject container and the second reject container, the control section differentiates whether each of the group of banknotes sent out from the temporary holding section is a normal banknote or a banknote to be stored separately from the normal banknote by referring to the differentiation result information stored in the memory section.

9. The banknote processing device according to claim 8, wherein the control section differentiates, among the group of banknotes to be sent out from the temporary holding section, banknotes that are counterfeit banknotes as the banknotes to be stored separately from the normal banknotes, as a result of the differentiation result information.

10. The banknote processing device according to claim 5, wherein the first reject container includes two specific banknote storage containers that are disposed adjacent vertically to each other, and when an upper banknote storage container out of the two specific banknote storage containers is full, banknotes are conveyed and stored in a lower banknote storage container of the two specific banknote storage containers.

11. The banknote processing device according to claim 5, further comprising:

a control section; and a memory section, wherein the control section stores, in the memory section, differentiation result information that indicates the differentiation results to differentiate between the suitable, counterfeit and unsuitable banknotes, and further wherein when the suitable, counterfeit and unsuitable banknotes stored in the temporary holding section are sent out to be stored in the plurality of banknote storage containers, the first reject container and the second reject container, the control section differentiates whether each of the suitable, counterfeit and unsuitable banknotes sent out from the temporary holding section is a one of the suitable banknotes, one of the counterfeit banknotes, or one of the unsuitable banknotes by referring to the differentiation result information stored in the memory section.

* * * * *